US008496311B2

(12) United States Patent
Watanabe

(10) Patent No.: US 8,496,311 B2
(45) Date of Patent: Jul. 30, 2013

(54) INKJET RECORDING APPARATUS AND INKJET RECORDING METHOD

(75) Inventor: Hidenori Watanabe, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 13/182,327

(22) Filed: Jul. 13, 2011

(65) Prior Publication Data

US 2012/0013662 A1 Jan. 19, 2012

(30) Foreign Application Priority Data

Jul. 16, 2010 (JP) ..... 2010-161571

(51) Int. Cl.
*B41J 29/38* (2006.01)

(52) U.S. Cl.
USPC ..... 347/9

(58) Field of Classification Search
None
See application file for complete search history.

(56) References Cited

U.S. PATENT DOCUMENTS

2010/0149237 A1* 6/2010 Takabayashi et al. ..... 347/9

FOREIGN PATENT DOCUMENTS

| | | | | |
|---|---|---|---|---|
| JP | 61-59911 | B | | 12/1986 |
| JP | 61-59913 | B | | 12/1986 |
| JP | 61-59914 | B | | 12/1986 |
| JP | 11-240148 | A | | 9/1999 |
| JP | 03530843 | B2 | | 5/2004 |
| JP | 2007-69575 | A | | 3/2007 |
| JP | 2007069575 | A | * | 3/2007 |
| JP | 2008-168626 | A | | 7/2008 |

* cited by examiner

*Primary Examiner* — Stephen Meier
*Assistant Examiner* — Tracey McMillion
(74) *Attorney, Agent, or Firm* — Canon U.S.A., Inc. IP Division

(57) ABSTRACT

A recording apparatus according to the present invention includes a temperature sensor to detect a temperature of a recording head and a control unit to control a pulse waveform, a pulse width forming a drive pulse, and a voltage. The drive pulse supplied to an electrothermal transducer is selected according to information about thermal conduction characteristics of the recording head and the temperature of the recording head detected by the temperature sensor.

10 Claims, 13 Drawing Sheets

| TEMPERATURE [°C] | PULSE No. |
|---|---|
| 24~27 | 1 |
| 27~30 | 2 |
| 30~33 | 3 |
| 33~36 | 4 |
| 36~39 | 5 |

FIG.5

| THICKNESS LESS THAN 7.5μm | THICKNESS 7.5μm OR MORE AND LESS THAN 12.5μm | THICKNESS 12.5μm OR MORE | |
|---|---|---|---|
| TEMPERATURE A [°C] | TEMPERATURE B [°C] | TEMPERATURE C [°C] | PULSE No. |
| 24~28 | 24~27 | 24~27 | 1 |
| 28~32.5 | 27~30 | 27~29 | 2 |
| 32.5~37 | 30~33 | 29~32 | 3 |
| 37~40 | 33~36 | 32~34 | 4 |
| 40~42 | 36~39 | 34~36 | 5 |

P1: PRE-PULSE (= T1)
P2: INTERVAL TIME (= T2 - T1)
P3: MAIN PULSE (= T3 - T2)
Vop: DRIVE VOLTAGE

INKJET RECORDING APPARATUS AND INKJET RECORDING METHOD

BACKGROUND OF THE INVENTION

1. Field of the Invention

The present invention relates to an inkjet recording apparatus and an inkjet recording method, and in particular, relates to an inkjet recording apparatus and an inkjet recording method that inhibit quality degradation caused by a change in discharge quantity of ink.

2. Description of the Related Art

In recent years, higher performance of a recording apparatus used in a printer, copying machine, facsimile and the like is increasingly demanded and not only fast recording/full-color recording, but also high-resolution image recording equivalent to a silver halide photography is called for. Confronted with such demands, an inkjet recording apparatus is superior in fast recording and high-quality recording to recording apparatuses that adopt other recording methods because the inkjet recording apparatus can discharge fine ink droplets at a high frequency. Particularly, the method of using bubbles generated by an electrothermal converter (hereinafter, referred to as a heater) like a heater element as a means for discharging ink droplets, the so-called thermal inkjet recording method (for example, Japanese Patent Publication No. 61-59911) can as its feature make miniaturization of an apparatus easy and create higher-density images.

The thermal inkjet recording method is a method by which an electric signal (hereinafter, referred to as a pulse) is applied to a heater to be converted into thermal energy in an inkjet recording head (hereinafter, referred to a head or a recording head), the thermal energy is used to cause ink to film-boil, and pressure of bubbles caused by the boiling is used to cause the ink to discharge so that discharged ink droplets adhere to a recording medium and dots are formed to output an image in the end.

According to the thermal inkjet recording method, the discharge quantity of ink is known to vary depending on viscosity of the ink. The viscosity of ink varies widely depending on the temperature. The discharge quantity of ink varies depending on the temperature of ink near the heater. Because the viscosity of ink increases as a temperature decreases, thereby reducing fluidity of ink and growth of bubbles caused by film boiling is less promoted with a decreasing temperature, the discharge quantity of ink varies due to variations in temperature of ink near the heater. Thus, due to a head temperature rise caused by heating of the heater resulting from printing, the discharge quantity of ink increases compared with that before the head temperature rises.

Therefore, if the head temperature changes during recording such as printing, particularly in recording an image like photograph, a change in density occurs in an output image. As a result, unevenness in density may arise in a recorded image, causing degradation in recording quality. This conspicuously appears due to a dramatic change of the head temperature when the heater is driven at a higher frequency or the number of discharge ports is increased to lengthen the line length of the discharge ports array to realize fast recording demanded in recent years.

As described above, a problem in achieving a faster recording speed is image degradation originating from variations in discharge quantity of ink due to a temperature rise of the recording head. Thus, to obtain an excellent image, various kinds of control to stabilize the discharge quantity of ink discharged from the recording head have been performed for the purpose of inhibiting an occurrence of unevenness in density in a recorded image as much as possible (see Japanese Patent Publication No. 61-59913 and Japanese Patent Publication No. 61-59914).

In the inkjet recording method in which ink is rapidly heated by applying a pulse to a heat element to cause a change of state of the ink from the liquid phase to the gas phase to generate a boiling force, the discharge quantity is almost determined by the input condition of energy during the change of state from the liquid phase to the gas phase. Thus, after the ink changes to the gas phase, the discharge quantity is hardly affected no matter how energy is input.

One conventional measure against variations in discharge quantity originating from a temperature rise of the head in an inkjet recording apparatus is to control the input condition of energy until the state of the ink changes to the gas phase. For example, a time chart of the pulse to be applied to the recording head is illustrated in FIG. 9 as an example of the condition. A known method modulates the discharge quantity by using a divided pulse (double pulse) as illustrated in FIG. 9 as a pulse applied to the recording head and controls a pre-pulse, a main pulse, and an interval time between these pulses.

The pulse width of a pulse to drive the recording head and a drive voltage Vop are determined by the area of a heater board where the heater is arranged, heater resistance, film structure of the heater board, or structure of a nozzle formed by discharge ports and flow paths of the recording head.

Based on temperature information from a temperature detecting element (hereinafter, described as a temperature sensor) provided in the recording head, the waveform of at least one pulse of a pre-pulse P1, an interval time P2, and a main pulse P3 is modulated. In FIG. 9, times T1, T2, and T3 are a rise time or fall time of the applied pulse and indicate times to determine pulse widths of the pre-pulse P1, the interval time P2, and the main pulse P3 respectively.

The pre-pulse P1 is the pulse mainly to control the temperature of ink in the nozzle and the pulse width thereof is controlled according to the temperature detected by using the temperature sensor of the recording head. At this time, the pulse width thereof is controlled such that ink does not boil by the pre-pulse with too much thermal energy applied to the ink.

The interval time P2 is provided for the purpose of preventing interference between the pre-pulse P1 and the main pulse P3 and also for the purpose of making the temperature of the ink inside the nozzle uniform by diffusing thermal energy provided in the pre-pulse P1 into the ink from the heater.

The main pulse P3 provides energy to boil the ink to discharge ink droplets from the discharge port.

The discharge quantity of ink can be stabilized by adjusting the pulse width of the pre-pulse P1, the pulse width of the main pulse P3, and the interval time P2, which is the interval between these pulses. If, for example, the temperature of the recording head is low and the discharge quantity of ink decreases, the pulse width of the pre-pulse P1 is adjusted to a relatively broad width. Conversely, if the temperature of the recording head is high and the discharge quantity of ink increases, the pulse width of the pre-pulse P1 is adjusted to a relatively narrow width.

Thus, variations in discharge quantity can be inhibited by modifying the waveform of pulse based on the head temperature detected by the temperature sensor or the like.

To inhibit variations in discharge quantity with higher precision, various ways shown below have been devised.

As described above, the temperature of the recording head is detected by the temperature sensor provided in the recording head. Thus, if temperature detection performance of the detecting element varies, the temperature cannot be detected correctly and appropriate corrections of the discharge quantity cannot be made.

Japanese Patent Application Laid-Open No. 11-240148 discusses a method of correcting variations of the detected head temperature originating from variations of temperature detection precision of the temperature sensor provided in the recording head. According to Japanese Patent Application Laid-Open No. 11-240148, in addition to the temperature sensor provided in the recording head, a high-precision thermistor sensor is provided near the head inside the recording apparatus. The high-precision thermistor can determine approximately the correct temperature and by comparing temperatures detected by these two sensors before printing, an error of temperature measurement by the temperature sensor provided in the recording head can be checked.

As described above, corrections of the discharge quantity dealing with a change in head temperature are made by changing the pulse. If the resistance of the heater element varies, the heating value of the heater varies even if the same pulse is applied and, as a result, variations in discharge quantity may occur.

According to Japanese Patent Application Laid-Open No. 2007-69575, this problem is solved by allocating rank to each head based on the heater resistance and changing the pulse for each head based on the ranking.

As described above, it is the temperature near the heater that affects the discharge quantity of ink. On the other hand, the temperature of the recording head is detected by the temperature sensor provided in the recording head. In a common recording head, the temperature sensor is composed of a diode sensor or a thermistor provided on the heater board. The temperature sensor may be preferably arranged near each heater to directly measure the temperature near each heater, but a common inkjet head has heaters arranged densely. Therefore, the temperature sensor is structured such that one or several temperature sensors are arranged slightly apart from a region where heaters are arranged, which makes direct measurement of the temperature near each heater impossible.

Japanese Patent Application Laid-Open No. 2008-168626 discusses a method of inhibiting a discharge quantity change in a heater column by predicting from the temperature detected by the sensor the temperature distribution in the heater column in which heaters are arranged and applying an appropriate pulse to each heater. Japanese Patent Application Laid-Open No. 2008-168626 also discusses a phenomenon in which the temperature distribution in the heater column changes due to unevenness in thickness of the adhesive between the heater board and a member to which the heater board is bonded.

Japanese Patent No. 03530843 discusses a phenomenon in which the temperature detected by a temperature detection diode varies when the same signal is applied to a heater depending on the connection state between the heater board and a member to which the heater board is bonded. Japanese Patent No. 03530843 utilizes this phenomenon for non-discharge detection (detection that discharge is not executed) in consideration of variations of the connection state of the heads.

SUMMARY OF THE INVENTION

According to an aspect of the present invention, an inkjet recording apparatus includes a recording head having an electrothermal converter that generates thermal energy to discharge ink, a temperature detection unit to detect a temperature of the recording head, and a control unit that outputs drive conditions for driving the electrothermal converter according to a rank regarding thermal conduction characteristics of the recording head detected in advance and the temperature of the recording head detected by the temperature detection unit, to the recording head.

According to another aspect of the present invention, a recording method of an inkjet recording apparatus including a recording head having an electrothermal converter that generates thermal energy to discharge ink and a temperature detection unit to measure a temperature of the recording head, includes determining a rank of the recording head by measuring thermal conduction characteristics of the recording head, measuring the temperature of the recording head during a recording operation by the temperature detection unit, and determining drive conditions for the electrothermal converter during the recording operation from the rank and the temperature of the recording head measured by the temperature detection unit.

According to the present invention, an inkjet recording apparatus and an inkjet recording method that inhibit variations in discharge quantity originating from a temperature rise of a recording head to effectively inhibit image degradation can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5 is a diagram illustrating the pulse table for each head temperature according to the thickness of the adhesive between the heater board and the base plate.

DESCRIPTION OF THE EMBODIMENTS

Various exemplary embodiments, features, and aspects of the invention will be described in detail below with reference to the drawings.

An exemplary embodiment shown below is only one concrete example of the present invention and is not limited this example within the spirit of the present invention.

Figure 1:
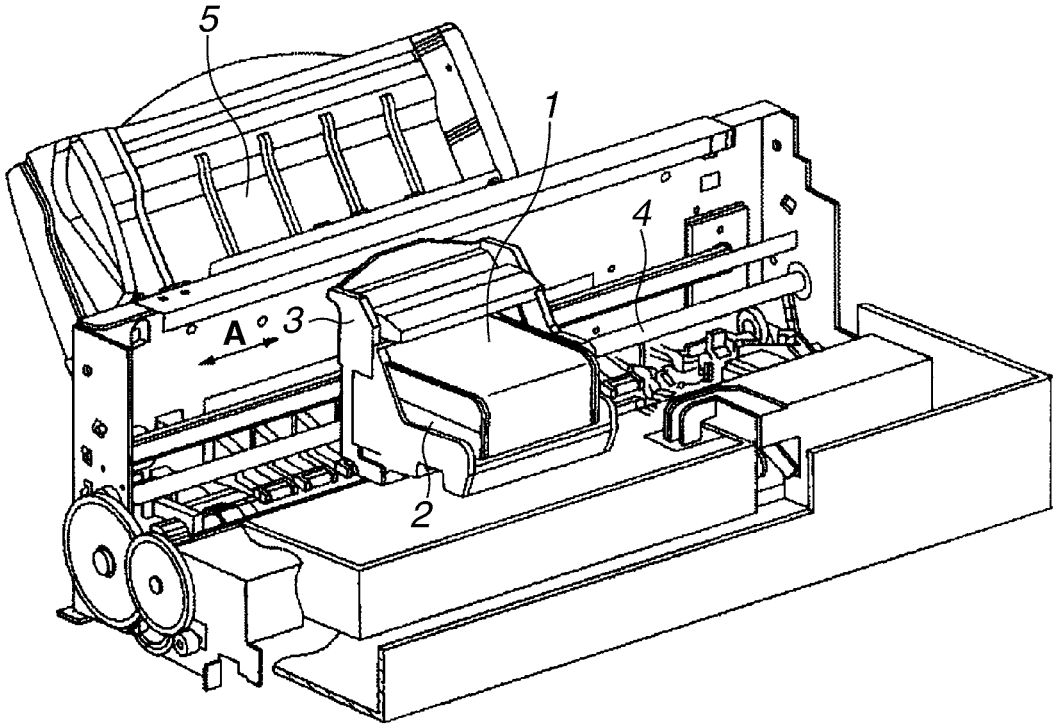
FIG. 1 is a perspective view illustrating the configuration of an inkjet recording apparatus.

FIG. 1 is a perspective view illustrating the configuration of an inkjet recording apparatus in the present exemplary embodiment. The inkjet recording apparatus in the present exemplary embodiment includes a carriage 3 in which an ink tank 1 and ahead 2 are integrated. The carriage 3 is movable in an arrow A direction along a guide rail 4. Also, a temperature sensor (not illustrated) to detect an environmental temperature is included in the carriage 3 or the like. A recording medium (not illustrated) is fed to a recording start position opposite to a surface where discharge ports of the head 2 are formed (hereinafter, referred to as a discharge port surface), from a feeding tray 5 by a feeding roller (not illustrated). When the recording medium is fed, the carriage 3 scans the recording medium and ink droplets are discharged to the recording medium from each discharge port of the head 2 during the scan. If the carriage 3 moves from one end to the other end of the recording medium, the recording medium is fed by a predetermined amount in a direction perpendicular to the scanning direction of the carriage, by a feed roller (not illustrated). By repeating a recording operation and a feeding operation alternately in this manner, an image is formed over the entire recording medium.

Figure 2A:
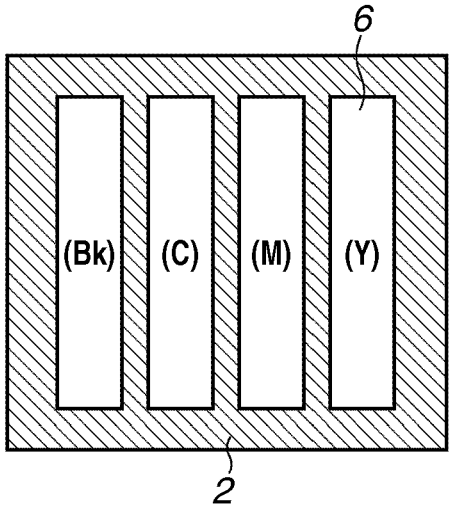
FIG. 2A is a plan view schematically illustrating the configuration of an inkjet recording head.

The configuration of the head 2 used in the present exemplary embodiment is schematically illustrated in FIG. 2A as a plan view. One or a plurality of boards 6 (hereinafter, referred to as heater boards) composed of silicon on which a plurality of discharge ports and heaters is formed is mounted in the head 2. FIG. 2A illustrates a case where the heater boards that discharge ink of four colors of black (Bk), cyan (C), magenta (M), and yellow (Y) are arranged.

An example in which one heater board is provided in the recording head 2 will be described below for convenience's sake.

Figure 2B:
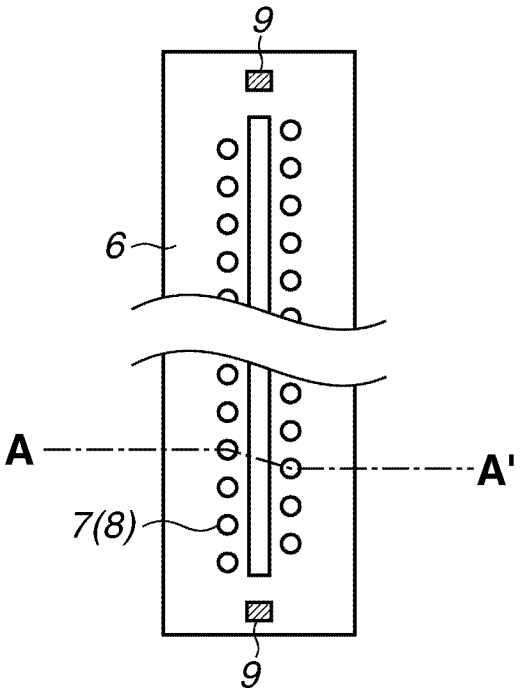
FIG. 2B is a plan view schematically illustrating the configuration of a heater board.

FIG. 2B is a plan view schematically illustrating the configuration of a heater board. A plurality of discharge ports 7 and heaters 8(not illustrated) that are electrothermal converters corresponding to each discharge port is placed on most of the silicon substrate (heater board 6) provided with semiconductor elements such as MOS-FET manufactured by a general semiconductor process. A temperature sensor 9, which is a temperature detection unit to detect the temperature on the heater board 6, is arranged near each of both ends of the heater board 6 in the longitudinal direction. In the present exemplary embodiment, the temperature sensor is assumed to be a diode and an example in which two temperature sensors are provided in the heater board is shown. As described above, discharge ports and heaters are built on the heater board in high density in a general thermal inkjet recording system and thus, it is difficult to arrange a diode used as a temperature sensor in the heater column to correspond to each heater. Thus, in a general recording head, as illustrated in FIG. 2B, the temperature sensor 9 is arranged near each of both ends of the heater board in the longitudinal direction.

Figure 2C:
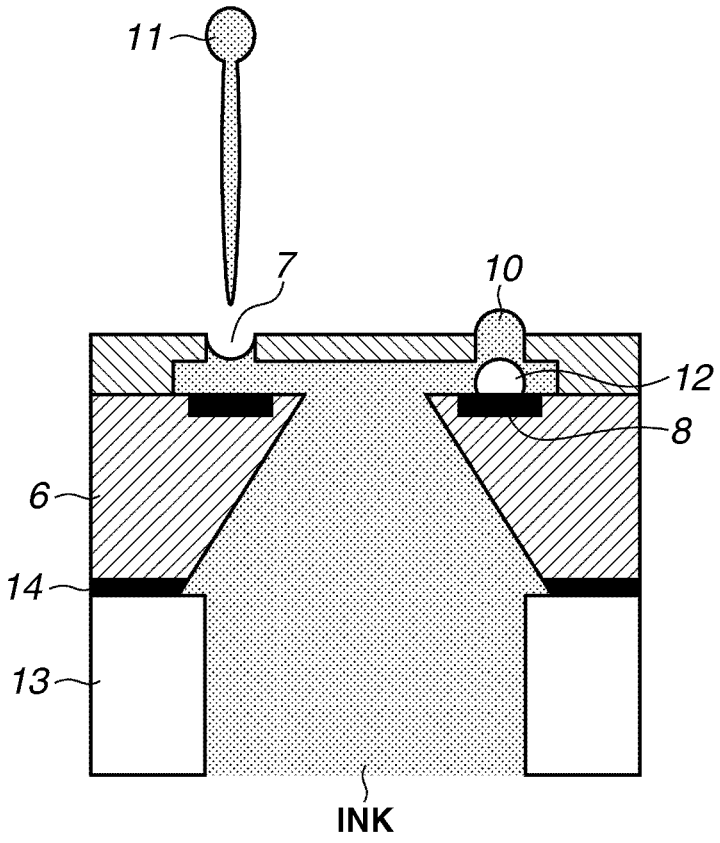
FIG. 2C is a diagram schematically illustrating a cross section along an A-A' line in FIG. 2B.

FIG. 2C illustrates an outline sectional view of the recording head. FIG. 2C is a sectional view of a portion indicated by the A-A' line in FIG. 2B. Each heater 8 is arranged on the heater board 6 almost immediately below each discharge port 7 to discharge ink 10 from each discharge port 7. The principle of discharging the ink 10 is to generate bubbles 12 by giving thermal energy to the heater 8 to film-boil the ink 10 and to use boiling pressure thereof to discharge the ink 10 as ink droplets 11. The heater board of the head used in the present exemplary embodiment and a support member (hereinafter, referred to also as a base plate) 13 serving as a foundation and made of alumina or the like are connected by an adhesive 14. The temperature of the heater board 6 is prevented from rising too high by dissipating heat generated in the heater board 6 to the base plate 13. A resin material having thermosetting characteristics such as an epoxy resin can be used as the adhesive 14.

The discharge quantity variation inhibition method related to features of the present invention will be described in detail below. As described above, if the heater resistance varies, the discharge quantity of ink varies. To clarify the point of the present invention, a case where the heater resistance is produced almost according to the design value will be described below.

First, the inhibition method of variations in discharge quantity will be described.

As described above, it is the temperature near the heater that affects the discharge quantity of ink and temperature sensors are arranged in specific portions of the heater board in a general recording head. Thus, the temperature distribution near each heater cannot be directly measured. However, if the head structure and printing conditions are determined, the temperature distribution in the heater column can be predicted from temperatures detected by temperature sensors. Thus, variations in discharge quantity can be inhibited by detecting the temperature by the temperature sensors and switching the pulse (drive pulse of the heater) based on the temperature.

Figures 3A, 3B:
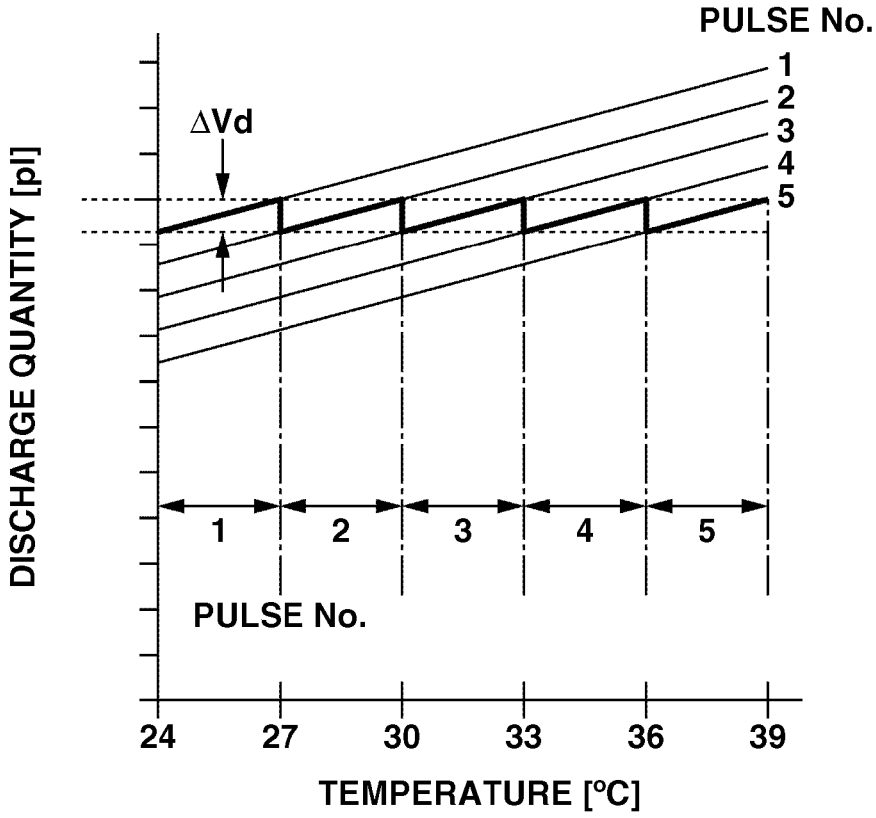
FIG. 3A is a graph illustrating a relationship between a head discharge quantity and head temperature according to various pulses to drive an inkjet recording head.
FIG. 3B is a diagram of a pulse table illustrating a selection example of the pulse for each temperature range of the inkjet recording head.
Figure 3C:
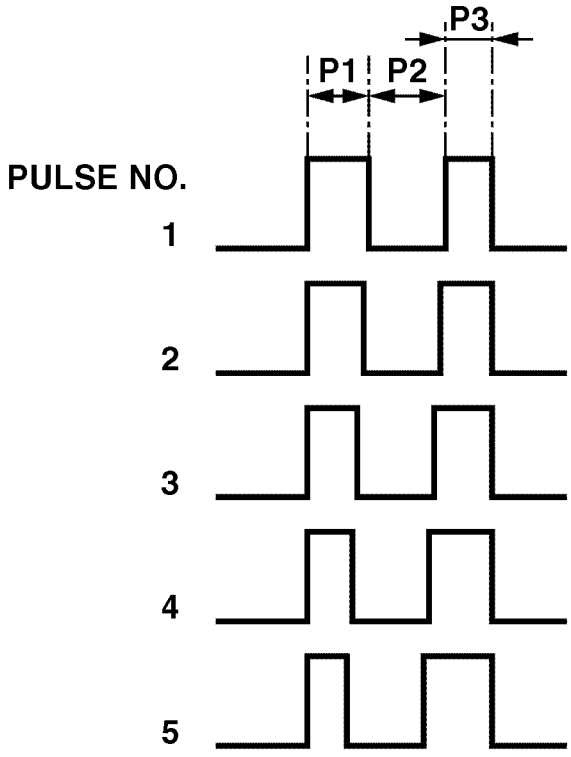
FIG. 3C is a diagram illustrating waveforms of various pulse Nos. in the pulse table illustrated in FIG. 2B.

Though the temperature measured by the temperature sensor and the temperature in the heater column are different depending on printing conditions, the relationship (pulse table) between the head temperature detected by the temperature sensor and the pulse is determined so that unevenness in density of printing determined by the desired printing condition is inconspicuous. In this case, the pulse table may be determined based on, instead of the temperature measured by one temperature sensor, an average value of temperatures measured by a plurality of temperature sensors present in the heater board. FIG. 3A illustrates the relationship between the discharge quantity of the recording head and the head temperature. FIG. 3B illustrates the correspondence between the head temperature range in FIG. 3A and the pulse No. FIG. 3C illustrates each pulse No. and the pulse corresponding to each pulse No. The pulse is formed based on conditions of the pulse waveform, pulse width, and voltage. The number indicated by the pulse No. in FIG. 3A corresponds to numbers illustrated in FIGS. 3B and 3C. As illustrated in FIG. 3A, the relationship between the discharge quantity and head temperature is different for each pulse, however, the discharge quantity increases as a head temperature increases, in each pulse. If a comparison is made at the same head temperature, the discharge quantity decreases as a pulse No. increases.

Therefore, the pulse may be switched each time the temperature changes according to a pulse table as illustrated in FIG. 3B to inhibit a change in discharge quantity accompanying a head temperature rise.

In this manner, as illustrated in FIG. 3A, the discharge quantity can be controlled such that the range of variations in discharge quantity is within ΔVd that causes no problem for images, according to the temperature of the recording head.

FIG. 3C illustrates the pulse corresponding to the pulse No. The discharge quantity can be controlled by changing the width of the pre-pulse P1 and also changing the width of the main pulse P3 accordingly.

The discharge quantity can be corrected based on the temperature of the temperature sensor provided in the heater board because the temperature in the heater column can be predicted from the temperature detected by the temperature sensor.

However, if the connecting state between the heater board and the base plate is different, the temperature distribution in the heater column is different even if the temperature detected by the temperature sensor is the same, so that variations in discharge quantity may not be inhibited satisfactorily.

Figure 4:
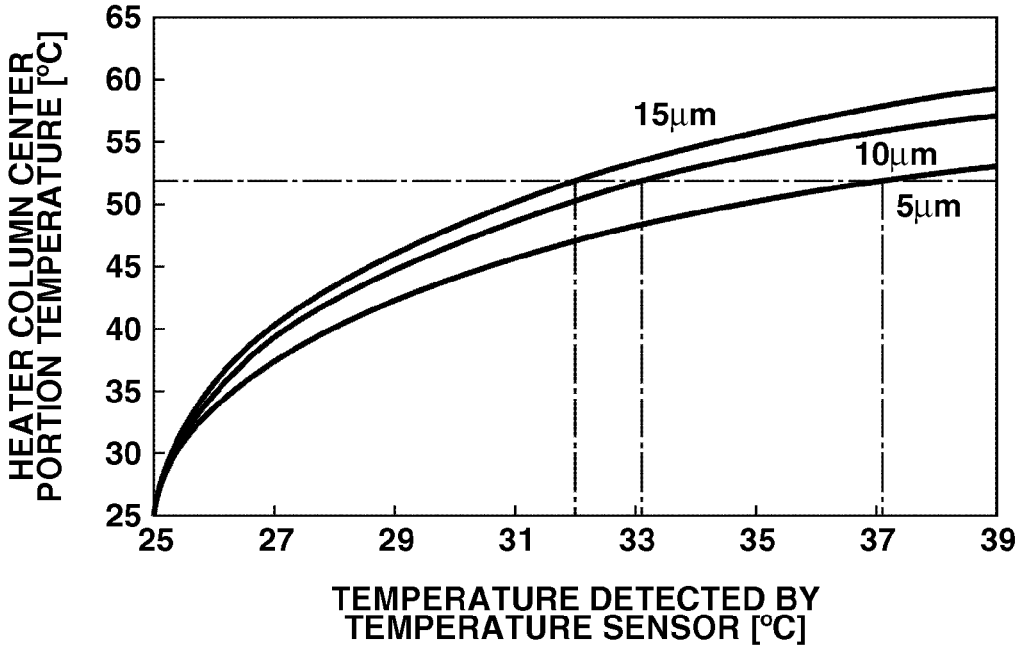
FIG. 4 is a graph illustrating a relationship between the temperature detected by a temperature sensor and the temperature in a heater column center when the thickness of an adhesive bonding a heater board and a base plate is different.

FIG. 4 illustrates the correlation between the temperature detected by the temperature sensor and the temperature in the heater column center when the thickness of the adhesive is 10 μm, which is the center value of design, and the thickness changes to 5 μm and 15 μm. The temperature in the heater column center is a temperature measured by infrared thermography.

In the present exemplary embodiment, it is assumed that the discharge quantity is 5 pl, the number of discharge ports in one discharge port column is 640, the number of discharge port columns is 2, the driving frequency is 30 kHz, the voltage applied to the heater is 24 V, and the pulse width (total of the pre-pulse and main pulse) is 1 μs.

FIG. 4 illustrates that if the thickness of the adhesive is different, in other words, thermal conduction characteristics of the recording head are different, the correlation between the temperature detected by the temperature sensor and the temperature in the heater column center is different. For example, when the temperature in the heater column center is 52° C., the temperature detected by the temperature sensor is about 32° C., 33° C., and 37° C. when the thickness of the adhesive is 5 μs, 10 μs, and 15 μs respectively.

While it is relatively easy to make the thickness of the adhesive bonding the heater board and the base plate uniform in a head in which the number of heaters is small and the size (board outside dimensions) of the heater board is small, it is difficult to realize uniformity of the thickness of the adhesive particularly in a head in which the number of heaters is large and the size of the heater board is large because it is difficult to control the thickness of the adhesive between the heater board and the base plate in a wide range.

The reason will be described concretely below.

Figure 10:
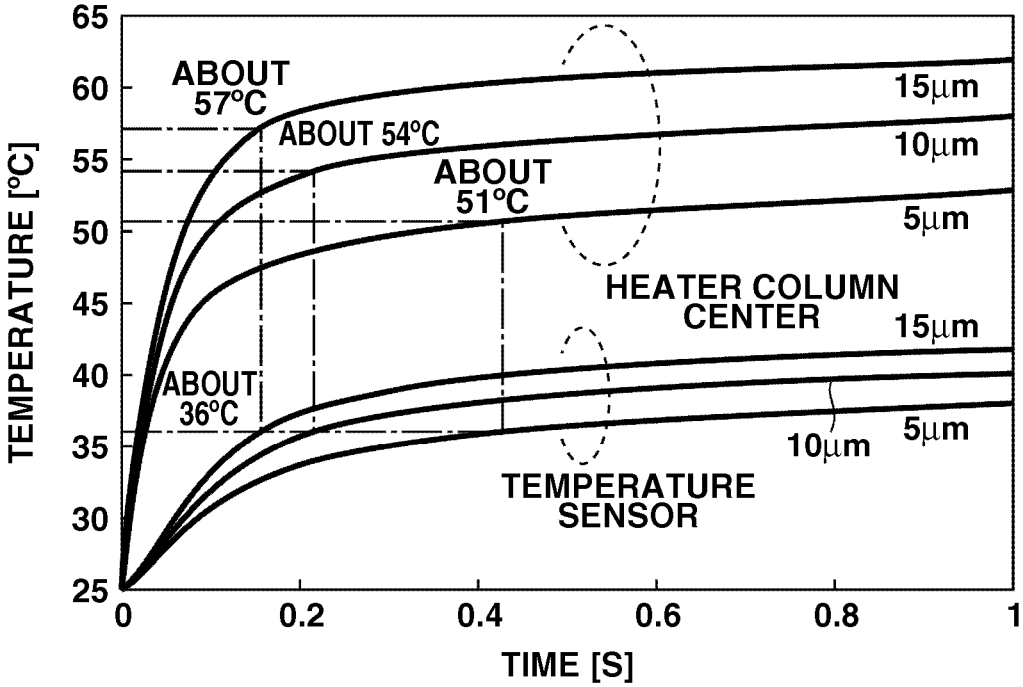
FIG. 10 is a diagram illustrating the temperatures of the temperature sensor and a heater column center.

FIG. 10 illustrates the temperature detected by the temperature sensor and the temperature in the heater column center when the connection state between the heater board and the member to which the heater board is connected changes. If the heater board and the member to which the heater board is connected by an adhesive, thermal conduction characteristics between these members in the recording head change if the thickness of the adhesive changes.

More specifically, if the thickness of the adhesive increases, thermal resistance between these members increases and, if the thickness of the adhesive decreases, thermal resistance between these members decreases. FIG. 10 illustrates the temperature of the temperature sensor and the temperature in the heater column center when the thickness of the adhesive is 5 μm, 10 μm, and 15 μm. FIG. 10 illustrates temperature changes when ink is discharged continuously for 1 second from the head whose discharge quantity is 5 pl, the number of discharge ports is 1280, driving frequency is 30 kHz, voltage (drive voltage) applied to the heater is 24 V, and pulse width is 1 μs. The temperature in the heater column center is a temperature measured by infrared thermography. When a thickness of the adhesive increases, as illustrated in FIG. 10, both the temperature detected by the temperature sensor and the temperature in the heater column center rise compared with a case where the thickness of the adhesive is thinner.

The pulse is changed based on the temperature detected by the temperature sensor to predict changes in discharge quantity due to a temperature rise of the recording head occurring in the printing. As described above, the temperature that affects the discharge quantity is the temperature near the heater. If the head structure and printing conditions are determined, the temperature near the heater can be predicted from the temperature detected by the temperature sensor under predetermined printing conditions.

However, even if the head is manufactured under the same conditions, relationship between the temperature detected by the temperature sensor and the temperature in the heater column center change if, as described above, the thickness of the adhesive varies and thermal conduction characteristics change from recording head to recording head. Thus, if thermal conduction characteristics of recording heads manufactured under the same conditions vary, satisfactory corrections of the discharge quantity cannot be made. As illustrated in FIG. 10, if the temperature detected by the temperature sensor is, for example, 36° C., the temperature in the heater column center is different, namely it is about 57° C., 54° C., and 51° C. in order when the thickness of the adhesive is 5 μm, 10 μm, and 15 μm respectively. More specifically, if the thickness of the adhesive varies, the discharge quantity is different even if the discharge quantity is corrected based on the temperature sensor because the temperature in the heater column center is different. That is, variations in discharge quantity cannot be adequately inhibited with information about the temperature sensor alone.

In other words, if a recording operation is performed by using the relationship (pulse table) between the recording head temperature and the pulse determined by setting the temperature in the heater column center at about 54° C. assuming that the thickness of the adhesive is 10 μm, the temperature is higher than the predicted temperature in a head in which the thickness of the adhesive is 10 μm or more and the temperature is lower than the predicted temperature in a head in which the thickness of the adhesive is 10 μm or less. Therefore, the discharge quantity becomes more than the initially intended discharge quantity in ahead in which the adhesive is relatively thick and the discharge quantity becomes less than the initially intended discharge quantity in a head in which the adhesive is relatively thin. Thus, due to production variations of the head, the initially intended variation corrections of the discharge quantity cannot be made satisfactorily.

This phenomenon occurs because thermal conductivity of the adhesive is low compared with thermal conductivity of the silicon substrate used for the heater board or the support member of alumina used for the base plate. Because it becomes more difficult to efficiently dissipate heat generated by the electrothermal transducer to the base plate as a thickness of the adhesive increases, such a difference of temperatures detected by the temperature sensor arises. Concrete values of thermal conductivity are about 150 W/(m·K) for the silicon substrate, about 25 W/(m·K) for alumina, and about 0.3 W/(m·K) for epoxy resin. This also shows that, compared with the silicon substrate and alumina, thermal conductivity of the adhesive is extremely low and it is hard for the adhesive to conduct heat.

Thus, the present invention provides a pulse table to determine the drive condition (pulse) corresponding to each state of the recording head. Therefore, even if production variations of the head occur, variation corrections of the discharge quantity can be made satisfactorily by switching the temperature segment corresponding to the drive condition based on thermal conduction characteristics of the recording head. More specifically, as illustrated in FIG. 4, if the thickness of the adhesive described above is different, in other words, thermal conduction characteristics of the recording head are different, the correlation between the temperature detected by the temperature sensor and the temperature in the heater column center is different. However, this correlation is known and the temperature segment for switching the pulse is modified for each thermal conduction characteristic of the recording head so that the temperature in the heater column center becomes almost the same.

The pulse table in the present exemplary embodiment is illustrated in FIG. 5. As illustrated in FIG. 5, the table has the temperature segment to determine the drive condition for each thermal conduction characteristic of the head, in other words, for each thickness of the adhesive. The pulse table is stored in a storage device (read-only memory (ROM)) 22 of the inkjet recording apparatus. FIG. 5 illustrates a case where the thickness of the adhesive is classified into three ranks. If the thickness of the adhesive is less than 7.5 μm, the pulse to drive the discharge is switched according to the temperature indicated by the temperature A in FIG. 5, if the thickness of the adhesive is 7.5 μm or more and less than 12.5 μm, according to the temperature indicated by the temperature B in FIG. 5, and if the thickness of the adhesive is 12.5 μm or more, according to the temperature indicated by the temperature C in FIG. 5.

Thus, by setting three levels A, B, and C for the temperature segment to switch the pulse, the temperature in the heater column center for each pulse No. can be made almost the same even if the thickness of the adhesive changes and the relationship between the temperature detected by the temperature sensor and the temperature in the heater column center changes. Accordingly, variations in discharge quantity can be inhibited satisfactorily.

Figure 6:
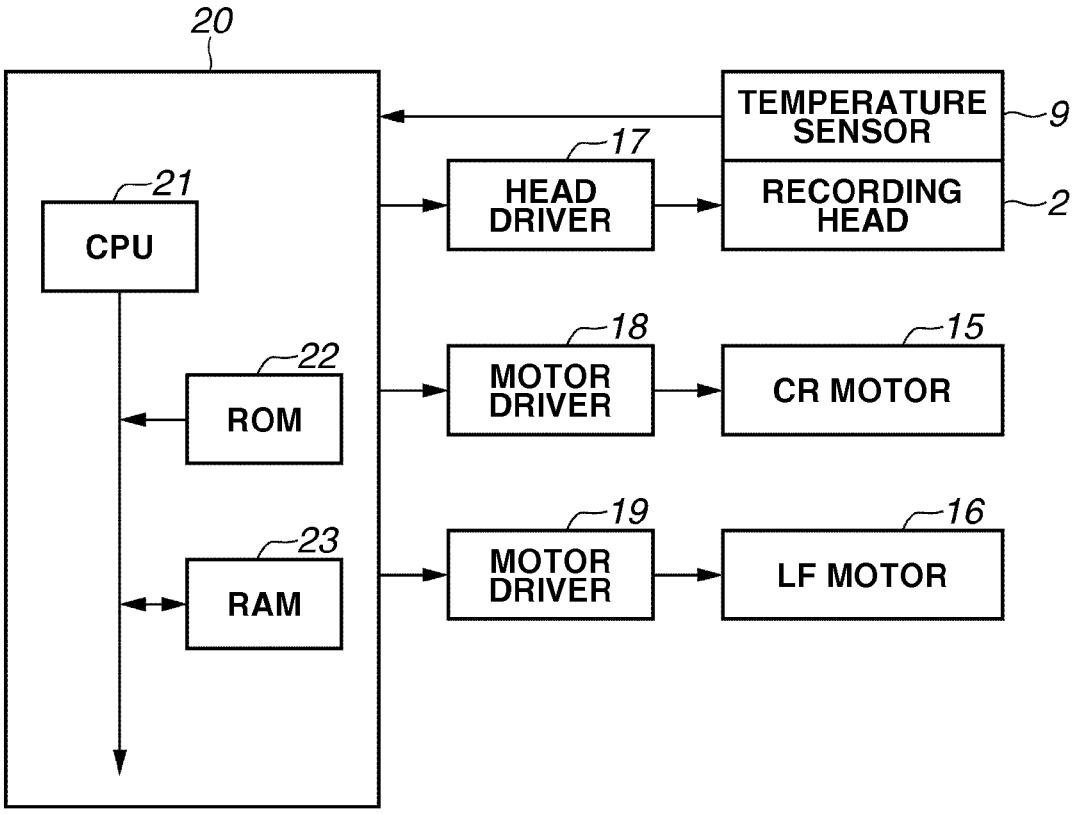
FIG. 6 is a block diagram illustrating a control configuration of the inkjet recording apparatus.

FIG. 6 is a block diagram illustrating the control configuration of the inkjet recording apparatus according to the present exemplary embodiment.

The recording head 2 is mounted with the temperature sensor 9 to detect the temperature of the recording head. The inkjet recording apparatus that drives the recording head 2 includes a CR motor 15 to move the carriage 3 on which the recording head 2 is mounted, an LF motor 16 to feed a recording medium, a head driver 17 to drive the desired heater of the recording head 2 according to recording data recorded in the recording medium, a driver 18 to move the CR motor 15, and a driver 19 to move the LF motor 16. Further, a controller 20 to control these drivers is provided which includes a central processing unit (CPU) 21, the ROM 22 to store data necessary for control, a random access memory (RAM) 23 to save data necessary for control. The ROM 22 includes a function to allow writing.

Figure 7:
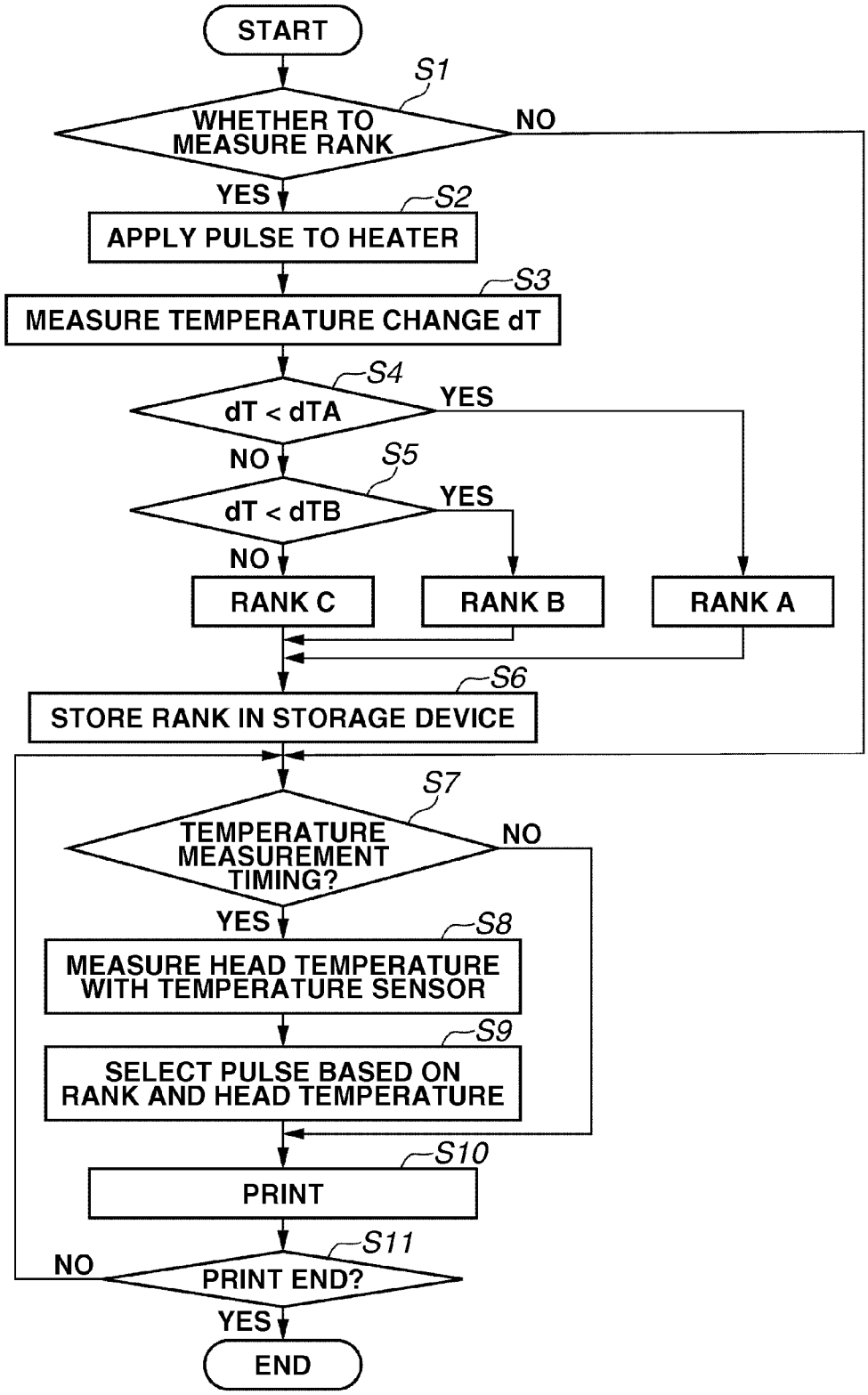
FIG. 7 is a flow chart to execute a printing method including a discharge quantity variation inhibition method.

FIG. 7 illustrates a flow chart to execute the discharge quantity variation inhibition method according to the present invention. Here, a case where the rank of thermal conduction characteristics is classified into three levels due to production variations of the head will be described.

Referring to FIG. 7, first the CPU 21 determines whether to measure the rank of thermal conduction characteristics of the recording head (step S1). If the CPU 21 determines to measure the rank (YES in step S1), the processing proceeds to step S2. If the CPU 21 determines not to measure the rank (NO in step S1), the processing proceeds to step S7. The rank of thermal conduction characteristics is measured when the storage device (ROM) of the present inkjet recording apparatus does not include rank data of the recording head, the recording head is replaced, or the user gives instructions to measure the rank.

At the recording start point when the ink of the recording head 2 mounted in the inkjet recording apparatus in the present exemplary embodiment is normally filled, the CPU 21 applies a pulse of predetermined electric energy to the heater 8 for a predetermined time (step S2) to measure the initial temperature of the temperature sensor 9 and a temperature change (dT) (step S3). If the value of dT is less than a first threshold dTA (YES in step S4), the rank of the recording head becomes A. If the value of dT is equal to the first threshold dTA or more (NO in step S4), the CPU 21 compares the value of dT with a second threshold dTB (step S5). If the value of dT is less than the second threshold dTB (YES in step S5), the rank of the recording head becomes B. If the value of dT is equal to the second threshold dTB or more (NO in step S5), the rank of the recording head becomes C. The information obtained in this manner is held in the storage device (ROM) of the recording head (step S6).

Heads using the adhesive of known thickness (the thickness of the adhesive is 7.5 μm and 12.5 μm) are used. In advance, to these heads, a pulse of predetermined electric energy which is applied to the heater at the time of determining the rank, is applied for a predetermined time to measure a change in head temperature. These measured values are set as the thresholds dTA and dTB.

Here, a concrete method to determine the above temperature change (dT) will be described with reference to FIG. 8. In other words, a method of detecting information about thermal conduction characteristics of each recording head will be described.

Figure 8:
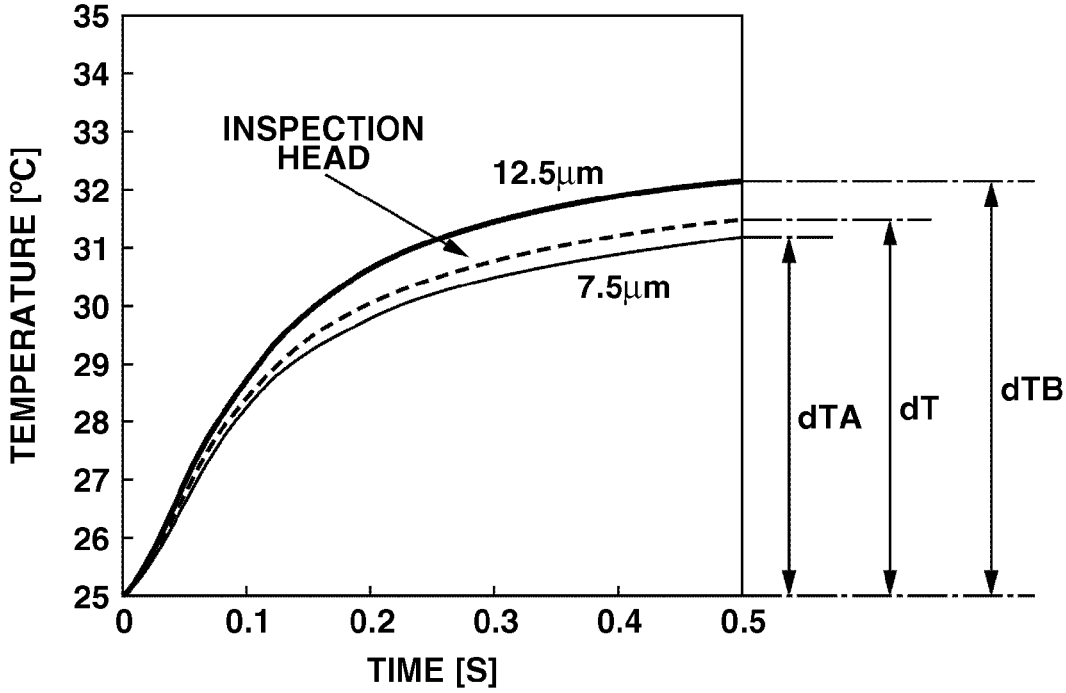
FIG. 8 is a diagram illustrating a heat conduction characteristic measurement method of the inkjet recording head.
Figure 9:
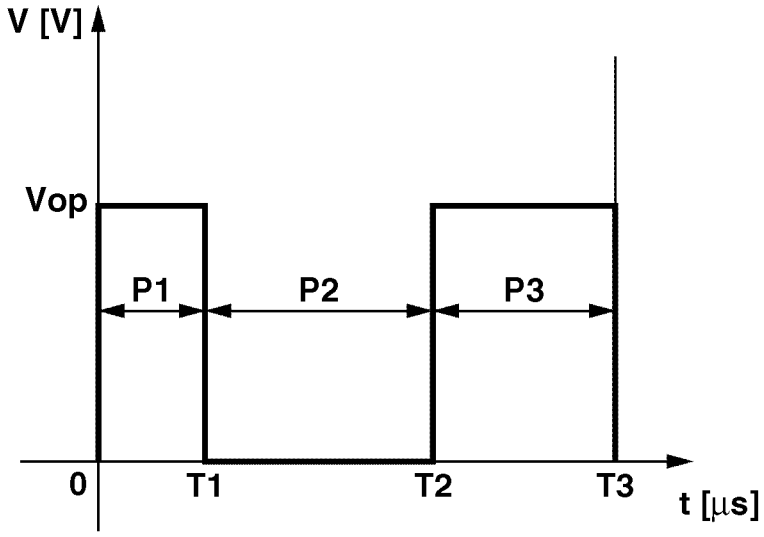
FIG. 9 is a diagram illustrating a time chart of the pulse applied to the recording head.

FIG. 8 illustrates changes in head temperature when the number of discharge ports in one discharge port column is 640, the number of discharge port columns is 2, the driving frequency is 30 kHz, the voltage applied to the heater is 24 V, the pulse width (total of the pre-pulse and main pulse) is 0.3 μs, and all heaters are driven for 0.5 s. Here, the change in head temperature when a pulse is applied for 0.5 second is defined as dT.

FIG. 8 illustrates temperature changes of the head (inspection head) whose thermal conduction characteristics should be measured and heads with the adhesive of the known thickness. As described above, the temperature detected by the temperature sensor rises as thickness of the adhesive increases when a pulse of the same electric energy is applied. If the temperature change of the head having the thickness of the adhesive of 7.5 μm after 0.5 second is dTA and the temperature change of the head having the thickness of the adhesive of 12.5 μm after 0.5 second is dTB, when the detected dT is compared with the thresholds dTA and dTB, it can be determined whether the thickness of the adhesive of the inspection head is less than 7.5 μm, equal to 7.5 μm or more and less than 12.5 μm, or equal to 12.5 μm or more. FIG. 8 illustrates a case where the thickness of the adhesive of the inspection head is equal to 7.5 μm or more and less than 12.5 μm.

To make the value of dT to be measured insusceptible to variations in discharge quantity due to variations of the discharge port diameter, it is preferable to set predetermined electric energy applied to the heater to a magnitude that does not cause an ink discharge. The pulse width of 0.3 μs set to cause temperature changes illustrated in FIG. 8 is a pulse condition under which no ink discharge is caused. The value of dT is also different depending on the head temperature when measurement of dT is started, that is, the initial temperature of the temperature sensor 9 and thus, the thresholds dTA and dTB for a plurality of initial temperatures are held in the storage device (ROM) in advance.

Therefore, steps S1 to S5 are a method of determining the rank of thermal conduction characteristics of the recording head to be detected in the present invention.

Next, the CPU 21 moves to steps of printing. As illustrated in FIG. 7, the CPU 21 first checks whether timing to detect the head temperature has come (step S7). The timing to detect the head temperature is set to a point, for example, before the carriage 3 scans a recording medium for printing or after the carriage moves from one end to the other of a recording medium. If the temperature detection timing has come (YES in step S7), the CPU 21 measures the detection temperature of the temperature sensor 9 (step S8). The CPU 21 of the controller 9 determines driving conditions for the heater for each thermal conduction characteristic based on the temperature measured by the temperature sensor 9 and the rank of the recording head held in step S6 by referring to the pulse table in which the temperature segment for determining drive conditions is written. Further, the CPU 21 transfers the determined driving conditions to the head driver 17 (step S9). Next, the recording head 2 does printing using the determined pulse (step S10). Next, the CPU 21 determines whether printing has finished (step S11).

In the present invention, as described above, variations in discharge quantity caused by a temperature rise of the head can satisfactorily be inhibited based on the pulse table stored in the storage device (ROM 22) in advance even if thermal conduction characteristics are different from recording head to recording head. In the present exemplary embodiment, the rank of the recording head is divided into three levels (temperature segments of A, B, and C in FIG. 5). However, the number of divided ranks is not limited to this and any number of ranks will do. In the present exemplary embodiment, the temperature segment to switch the pulse is modified for each thermal conduction characteristic if thermal conduction characteristics are different for each recording head, but the temperature segment may remain unchanged, instead the pulse corresponding to each temperature range of one temperature segment may be modified for each thermal conduction characteristic of the recording head.

In the recording head 2 in which each of a plurality of independent heater boards is connected to the recording head on one base plate 13 by an adhesive, the discharge quantity of each heater board can be controlled by performing drive control of each board.

Heretofore, a case where the inkjet recording apparatus has a function to detect thermal conduction characteristics for each head has been described. However, the above rank selection of the recording head may be made by a dedicated device to determine the rank before being installed in the inkjet recording apparatus. Its result is recorded in a storage device such as an EEPROM provided in the recording head. In this case, the rank of the recording head can be determined also by the dedicated device for determining the rank by performing an operation similar to that of the above method.

In this case, the inkjet recording apparatus reads information about thermal conduction characteristics of the head stored in the storage device provided in the recording head before starting printing and, based on this information and the head temperature detected by the temperature sensor 9, determines drive conditions by referring to the pulse table in which the temperature segment to determine drive conditions is written for each thermal conduction characteristic.

The present invention is also applicable to an inkjet recording head that performs a recording operation in which the same kind of ink is utilized for recording using a plurality of heater boards by arranging the plurality of heater boards on one base plate.

This configuration will be described by using an example.

Figure 11:
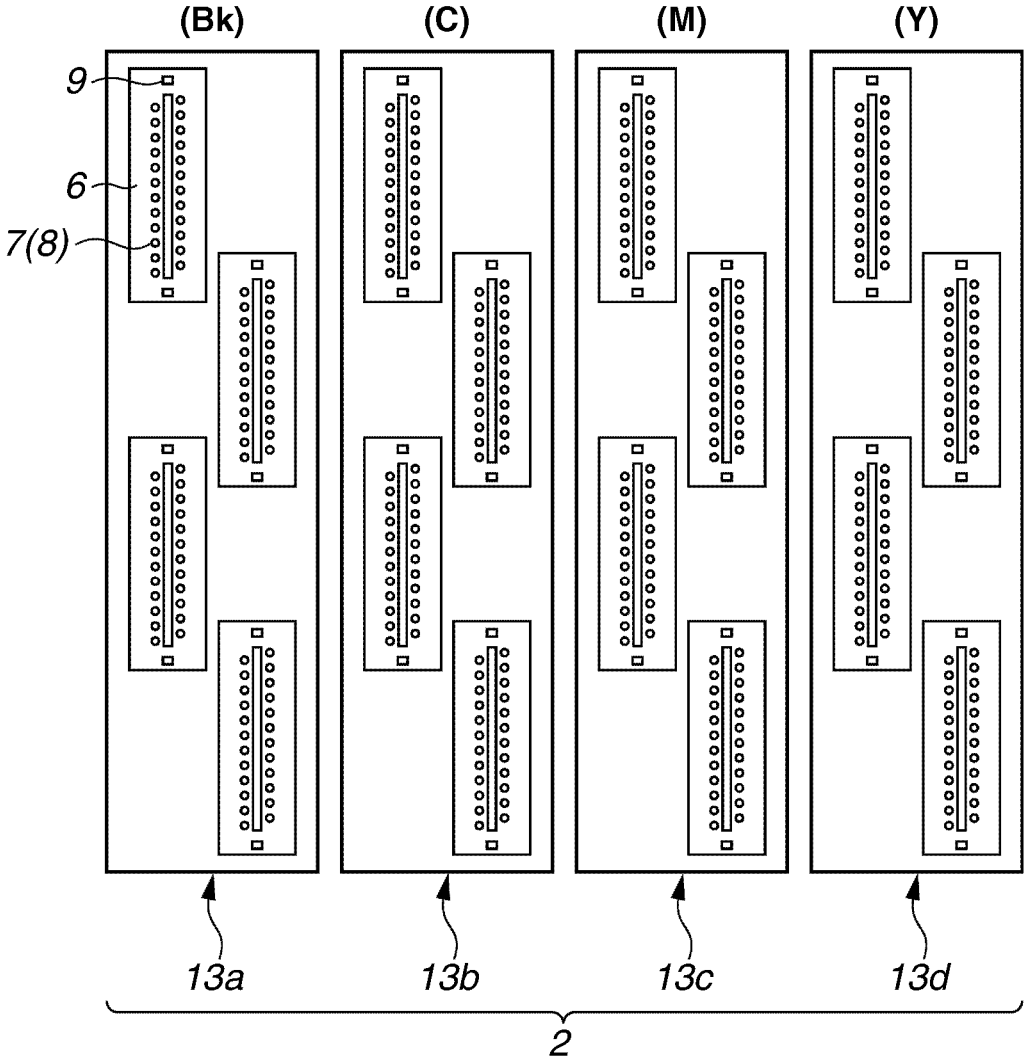
FIG. 11 is a plan view schematically illustrating the configuration of the inkjet recording head.

FIG. 11 is a schematic diagram illustrating the inkjet recording head of such a configuration. An example in which one kind of ink is recorded by using four heater boards is illustrated.

The recording head illustrated in FIG. 11 can perform a recording operation in a wide line width by arranging four heater boards continuously along an array direction in which heaters are arrayed. More specifically, each of the heater boards 6 is bonded and provided on one base plate 13 by the adhesive 14. The recording head 2 capable of discharging four kinds of ink (Bk, C, M, Y) is formed by providing the base plates 13 described above in a direction perpendicular to the array direction in four columns (13*a*, 13*b*, 13*c*, 13*d*).

If a plurality of heater boards 6 is arranged on the base plate 13, a difference of thermal conduction characteristics may arise due to a difference in thickness of the adhesive of each heater board 6. Even if the heater boards are the same, each of the heater boards 6 may discharge a different discharge quantity of ink. As a result, the density of printed matter may change in a width corresponding to the width of discharge ports array of each heater board, which causes unevenness of an image.

Thus, variations in discharge quantity of ink between heater boards can be reduced by determining the drive condition for each of the heater boards 6 by referring to the pulse table based on the head temperature detected by the temperature sensor 9 provided in each of the heater boards 6 and the rank of thermal conduction characteristics obtained according to the thickness of the adhesive between each heater board 6 and the base plate 13. Accordingly, control can be performed to reduce unevenness of an image even in the configuration as illustrated in FIG. 11. Also in this configuration, the rank of thermal conduction characteristics based on the thickness of adhesive can be determined by using the temperature sensor 9 or determined in advance by using another apparatus. FIG. 11 illustrates a configuration in which a plurality of the heater boards 6 using one kind of ink is arranged on one base plate, but the control may be performed similarly by arranging a plurality of the heater boards 6 to discharge a plurality of kinds of ink.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-161571 filed Jul. 16, 2010, which is hereby incorporated by reference herein in its entirety.

What is claimed is:

1. An inkjet recording apparatus that performs a recording operation by discharging ink, comprising:

a recording head having an electrothermal converter that generates thermal energy to discharge the ink;

a temperature detection unit to detect a temperature of the recording head; and a control unit that outputs drive conditions for driving the electrothermal converter according to a rank regarding thermal conduction characteristics of the recording head detected in advance and the temperature of the recording head detected by the temperature detection unit, to the recording head, wherein the recording head includes a board including the electrothermal converter, a support member that supports the board, and an adhesive that bonds the board and the support member, and wherein the rank varies according to a thickness of the adhesive.

2. The inkjet recording apparatus according to claim 1, further comprising:

a storage unit storing the drive conditions for the electrothermal converter corresponding to the temperature of the recording head for each of a plurality of ranks, wherein the control unit reads the drive conditions for the electrothermal converter from the storage unit based on the rank detected in advance and the temperature of the recording head measured by the temperature detection unit, and outputs the read drive conditions to the recording head.

3. The inkjet recording apparatus according to claim 1, wherein the drive conditions are determined by a pulse waveform and a pulse width forming a drive pulse of a voltage applied to the electrothermal converter.

4. The inkjet recording apparatus according to claim 1, wherein a predetermined thermal energy amount is generated in the electrothermal converter in timing separate from the recording operation, and the rank is determined based on temperature changes of the recording head measured by the temperature detection unit, which accompanies the thermal energy generation.

5. The inkjet recording apparatus according to claim 1, wherein a thickness of the adhesive of the recording head in use is different from a thickness of the adhesive at the time of manufacturing the recording head.

6. The inkjet recording apparatus according to claim 1, wherein the adhesive has a thermal conductivity lower than the thermal conductivity of the board or the support member.

7. A recording method of an inkjet recording apparatus including a recording head having a board including an electrothermal converter that generates thermal energy to discharge ink, a board support member, adhesive bonding the board and board support member, and a temperature detection unit to measure a temperature of the recording head, comprising:

determining a rank of the recording head by measuring thermal conduction characteristics of the recording head;

measuring the temperature of the recording head during a recording operation by the temperature detection unit; and determining drive conditions for the electrothermal converter during the recording operation from the rank and the temperature of the recording head measured by the temperature detection unit, wherein the rank varies according to a thickness of the adhesive.

8. The recording method according to claim 7, wherein determining the drive conditions includes:

reading the drive conditions for the electrothermal converter based on the rank of the recording head and the temperature of the recording head measured by the temperature detection unit, from a storage unit storing the drive conditions for the electrothermal converter selected based on the temperature of the recording head for each of ranks, and outputting the read drive conditions to the recording head.

9. The recording method according to claim 7, wherein determining the rank of the recording head includes:

heat generation generating a predetermined thermal energy amount by the electrothermal converter, measuring the temperature of the recording head during the heat generation by the temperature detection unit, and determining the rank of the recording head from the predetermined thermal energy amount and the measured temperature of the recording head.

10. The recording method according to claim 7, wherein the determining the rank of the recording head is performed in different timing from the timing of the recording operation.

* * * * *